US009228773B2

(12) United States Patent
Leistner et al.

(10) Patent No.: US 9,228,773 B2
(45) Date of Patent: Jan. 5, 2016

(54) TILT MONITOR AND STRESS CONTROLLER FOR ABSORPTION TYPE REFRIGERATOR

(75) Inventors: David William Leistner, Sidney, OH (US); Robert C. Heagey, Canyon County, CA (US)

(73) Assignee: DOMETIC SWEDEN AB (SE)

( * ) Notice: Subject to any disclaimer, the term of this patent is extended or adjusted under 35 U.S.C. 154(b) by 787 days.

(21) Appl. No.: 13/415,380

(22) Filed: Mar. 8, 2012

(65) Prior Publication Data

US 2012/0255317 A1 Oct. 11, 2012

Related U.S. Application Data

(60) Provisional application No. 61/450,508, filed on Mar. 8, 2011.

(51) Int. Cl.
*F25B 15/10* (2006.01)
*F25D 23/00* (2006.01)

(52) U.S. Cl.
CPC *F25D 23/00* (2013.01); *F25B 15/10* (2013.01)

(58) Field of Classification Search
CPC ..... F25D 23/00; F25B 15/10
USPC ..... 62/129, 141, 148, 476
See application file for complete search history.

(56) References Cited

U.S. PATENT DOCUMENTS 3,782,134 A * 1/1974 Meess ..... F25B 15/10 165/170
3,802,219 A * 4/1974 Blomberg ..... F25B 15/10 165/110
3,851,497 A * 12/1974 Blomberg ..... F25B 15/10 62/452
4,176,529 A * 12/1979 Stierlin ..... F25B 15/10 62/238.3
4,178,774 A * 12/1979 Almen ..... F25B 15/10 62/493
4,604,812 A 8/1986 Arjomand
4,669,696 A 6/1987 Petta
5,156,013 A 10/1992 Arima et al.
5,682,755 A * 11/1997 Uchida ..... F25B 49/043 62/148
5,738,084 A 4/1998 Hussong
6,009,721 A * 1/2000 Fukuda ..... F25B 15/02 62/112
6,212,902 B1 * 4/2001 Leistner ..... F25B 15/10 62/238.3
6,397,625 B1 * 6/2002 Kunze ..... F25B 15/10 417/208
6,748,762 B2 * 6/2004 Yamazaki ..... F25B 15/06 62/476
7,050,888 B2 5/2006 Schneider et al.
7,412,837 B2 8/2008 Karlsson et al.
7,874,178 B2 1/2011 McConnell et al.
2005/0119847 A1 6/2005 Park
2008/0060366 A1 * 3/2008 Leistner ..... F25B 49/043 62/148
2008/0115513 A1 * 5/2008 Unmack ..... F25B 49/043 62/148
2009/0090353 A1 4/2009 Grunberg et al.
2010/0107663 A1 5/2010 Tsung
2010/0280665 A1 11/2010 Fildes et al.
2012/0102981 A1 5/2012 Klein et al.

* cited by examiner

*Primary Examiner* — Emmanuel Duke
(74) *Attorney, Agent, or Firm* — Middleton Reutlinger

(57) ABSTRACT

An automated control device for monitoring the position angle of an absorption type cooling system or refrigerator that circulates a refrigerant, an absorbent, and a diffusion agent within a conduit system includes a housing, a controller with a processor within the housing, a sensor in communication with the controller for measuring the angle of inclination of the refrigerator, and a stress counter connected to the controller for counting increments of stress induced into the cooling system. The tilt monitoring control method prevents system stress, which in turn prevents personal and property damage due to hydrogen gas leaks, fires and explosions.

10 Claims, 4 Drawing Sheets

TILT MONITOR AND STRESS CONTROLLER FOR ABSORPTION TYPE REFRIGERATOR

REFERENCE TO RELATED APPLICATION

This application claims priority to U.S. Provisional Application No. 61/450,508, filed Mar. 8, 2011, which is hereby incorporated by reference.

BACKGROUND OF THE INVENTION

1. Field of the Invention

The invention relates generally to tilt control devices and, more particularly, to an operating control for a recreational vehicle (RV) refrigerator based upon monitoring tilt and stress conditions of the cooling system.

2. Description of the Prior Art

Gas absorption refrigerators are very sensitive to position angle. This presents a problem for refrigerators in vehicles. Recreational vehicles with refrigerators are required to be leveled to ensure normal refrigerator operation. This is because gas absorption refrigeration relies on gravity to recirculate the refrigerant (ammonia-water solution) downward through the evaporator and absorber sections to the leveling chamber. The angles of inclination in these sections are typically three to five degrees (3°-5°). If a RV refrigerator attempts to operate at an angle greater than five degrees (5°), the flow downward through the absorber is slowed or stopped and refrigerant "pools" in the lower portions of the absorber as a result of the unlevel attitude.

Operation at severe angles of inclination can lead to overheating of the boiler section of the cooling system when adequate levels of the refrigerant are not close enough to the boiler section to draw heat away from the heated section. This system stress is obviously undesirable. In extreme situations, the heated section continues to rise in temperature until the system ruptures releasing refrigerant and hydrogen into the vehicle. Hydrogen, being highly volatile, presents a risk of injury to persons and property as a result.

There is thus a need for an improved operating control for a recreational vehicle refrigerator that monitors tilt conditions of the fridge or at least a portion of its absorption system to safely control its operation and thus prevent system stress and ruptures.

SUMMARY OF THE INVENTION

The disadvantages heretofore associated with existing RV refrigeration systems are overcome by the disclosed design for a position angle and stress monitoring and operation control system.

A new operating control for a RV refrigerator uses an electronic controller to continuously monitor the position angle of the refrigerator so that the control can monitor the amount of time the refrigerator is energized at extreme position angles that would likely induce stress in the boiler section and other parts of the cooling system or refrigerator.

In one aspect of the invention, an automated control device is provided for monitoring the position angle of an absorption type cooling system or refrigerator. Such a cooling system or refrigerator of the invention may be of the type that circulates a refrigerant, an absorbent, and a diffusion agent within a conduit system. The device may include a housing, a controller with a processor within the housing, a sensor in communication with the controller for measuring the angle of inclination of the refrigerator, and a stress counter connected to the controller for counting increments of stress induced into the cooling system.

In another aspect, the controller receives signals and data from the sensor representing information about the tilt angle of the cooling system or refrigerator, and the processor analyzes the signals and instructs the stress counter to increment an amount in proportion to which the cooling system or refrigerator is off level. In another aspect of the invention, an automated control device for a refrigerator that has a closed fluid absorption type cooling system with a heat source for heating a mixture of flowable refrigerant and absorbent. The system may include a diffusion agent.

The device may include a sensor for measuring the angle of inclination of the refrigerator, a stress recorder for recording the amount of stress induced into the cooling system, and a controller for receiving signals from the sensor. The controller may be in communication with a processor executing instructions for: (i) analyzing the signals and data from the stress recorder to identify a condition representative of at least one of the signals and data, (ii) comparing the condition with a set of condition classifications, and (iii) limiting the time of operation of the refrigerator according to a time specified by at least one of the classifications.

In yet another aspect, the invention provides a method for controlling operation of an absorption type cooling system or refrigerator comprising the steps: (1) providing a sensor in communication with a controller for measuring the angle of inclination of the cooling system or refrigerator. The controller includes a processor; (2) providing a stress counter connected to the controller; and (3) by way of the processor, instructing that a stress counter be incremented in response to signals received from the sensor when the cooling system or refrigerator is off level.

In another aspect, the system may include a user interface connected to the controller so that a user may interact with and control the device.

One object of the invention is to provide an improved system and method for controlling operation of a RV refrigerator based on its position angle relative to level. Related objects and advantages of the invention will be apparent from the following description.

BRIEF DESCRIPTION OF THE DRAWINGS

The details of the invention, both as to its structure and operation, may be obtained by a review of the accompanying drawings, in which.

DETAILED DESCRIPTION OF INVENTION

The invention 10 is an electronic control for a recreational vehicle (RV) refrigerator 20 that can continuously monitor the position angle of the refrigerator during operation, record the amount of time the refrigerator is operated at various angles of inclination, and prevent further operation when safe time periods of operation corresponding to safe angles of inclination have been exceeded. It should be understood, however, the control device 10 may be used in connection with the monitoring of any absorption type cooling system or refrigerator that may experience changes in position angle during operation. One commercial application is described here for a RV refrigerator.

Figure 2:
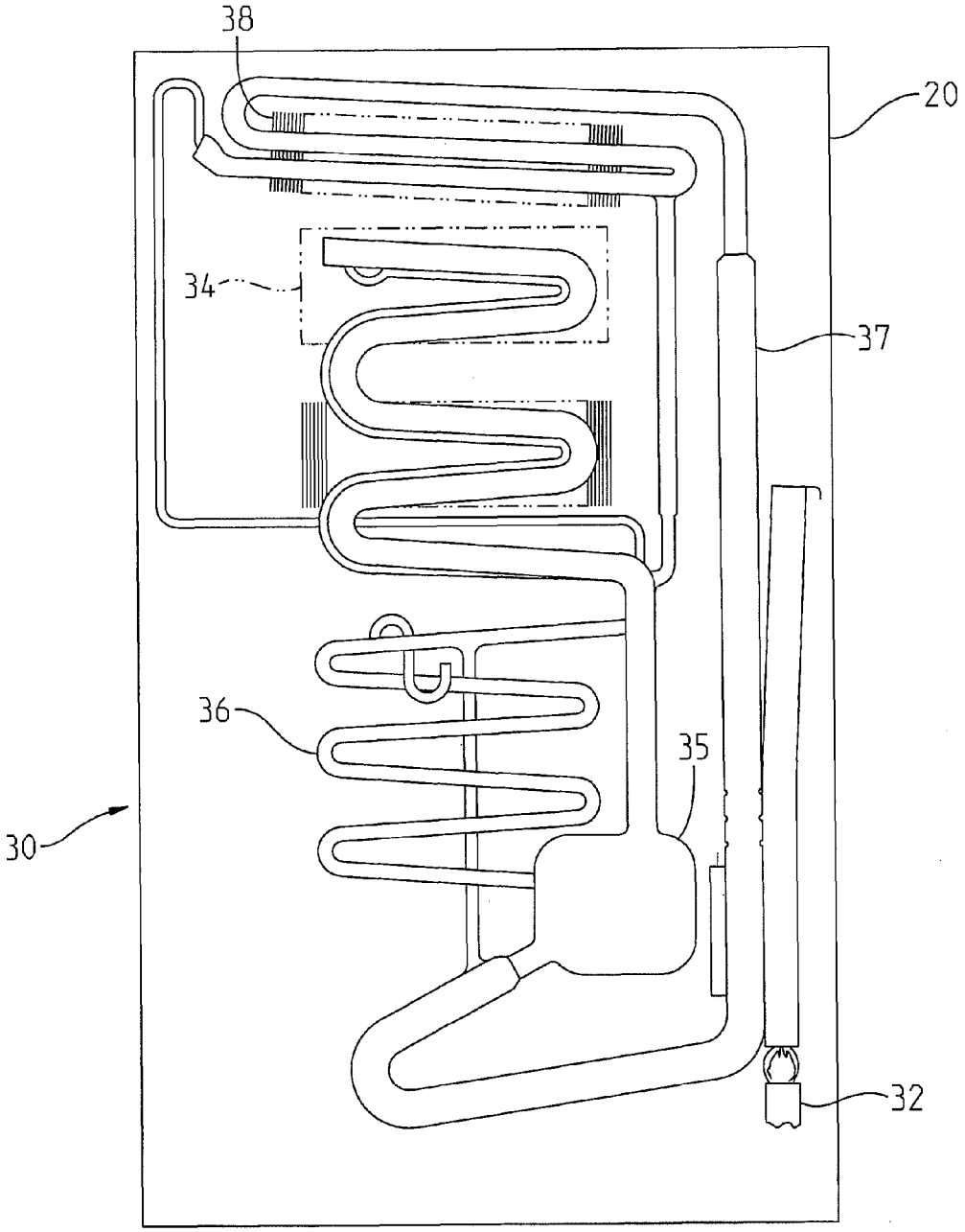
FIG. 2 is a plan view of the rear of a refrigerator showing the adsorption type cooling and conduit systems of the invention.

The typical RV refrigerator includes an absorption system 30 like the one shown schematically in FIG. 2. They use three substances: ammonia, hydrogen gas, and water. At standard atmospheric conditions, ammonia is a gas with a boiling point of −33° C., but a single-pressure absorption refrigerator is pressurized to the point where the ammonia is a liquid. The cycle is closed, with all hydrogen, water and ammonia collected and endlessly reused.

The cooling cycle starts with liquefied ammonia entering the evaporator 34 at room temperature. The ammonia is mixed in the evaporator with hydrogen. The partial pressure of the hydrogen is used to regulate the total pressure, which in turn regulates the vapor pressure and thus the boiling point of the ammonia. The ammonia boils in the evaporator, providing the cooling required. The next three steps serve to separate the gaseous ammonia and the hydrogen. They are known in the art, and skilled artisans will recognize that the following paragraphs are examples of means for accomplishing such gaseous separation.

First, in the absorber 35, the mixture of gases enters the bottom of an uphill series of tubes 36, into which water is added at the top. The ammonia dissolves in the water, producing a mixture of ammonia solution and hydrogen. The hydrogen is collected at the top of the absorber, with the ammonia solution collected at the bottom.

The second step is to separate the ammonia and water. Heat is applied to the solution to distill the ammonia from the water. In the example shown, a gas burner 32 is used. Electric and other types of heat sources may, of course, be used. Upon heating the mixture, some water remains with the ammonia, in the form of vapour and bubbles. This is dried in the final separation step, called the separator 37, which may be accompanied by passing it through an uphill series of twisted pipes with minor obstacles to pop the bubbles, allowing the collected water to drain back down near the area of the burner.

At step three, the pure ammonia gas enters the condenser 38. In this heat exchanger, the hot ammonia gas is cooled to room temperature and hence condenses to a liquid, allowing the cycle to restart.

Hydrogen has always been the preferred diffusion agent because it is the lightest gas having atomic number one and a mass of about the same. Its partial pressure, which regulates the overall pressure of the closed system, therefore, is small, easily calculable, and predictable as the element moves between phase changes and solution in the system. Hydrogen gas presents extreme risk, however, due to fire and explosion when a system ruptures.

In addition to the new monitoring device that is the subject of this application, Applicants have created and developed a new refrigeration unit that eliminates the risk of fire and explosion by using helium instead of hydrogen as the diffusion agent or "charging" gas. That sister application, U.S. Ser. No. 13/415,796 (now abandoned), is hereby incorporated by reference. It is, therefore, contemplated that the instant tilt monitoring control system 10 may be used to control a refrigeration unit like the one described in the sister application as well.

Figure 1:
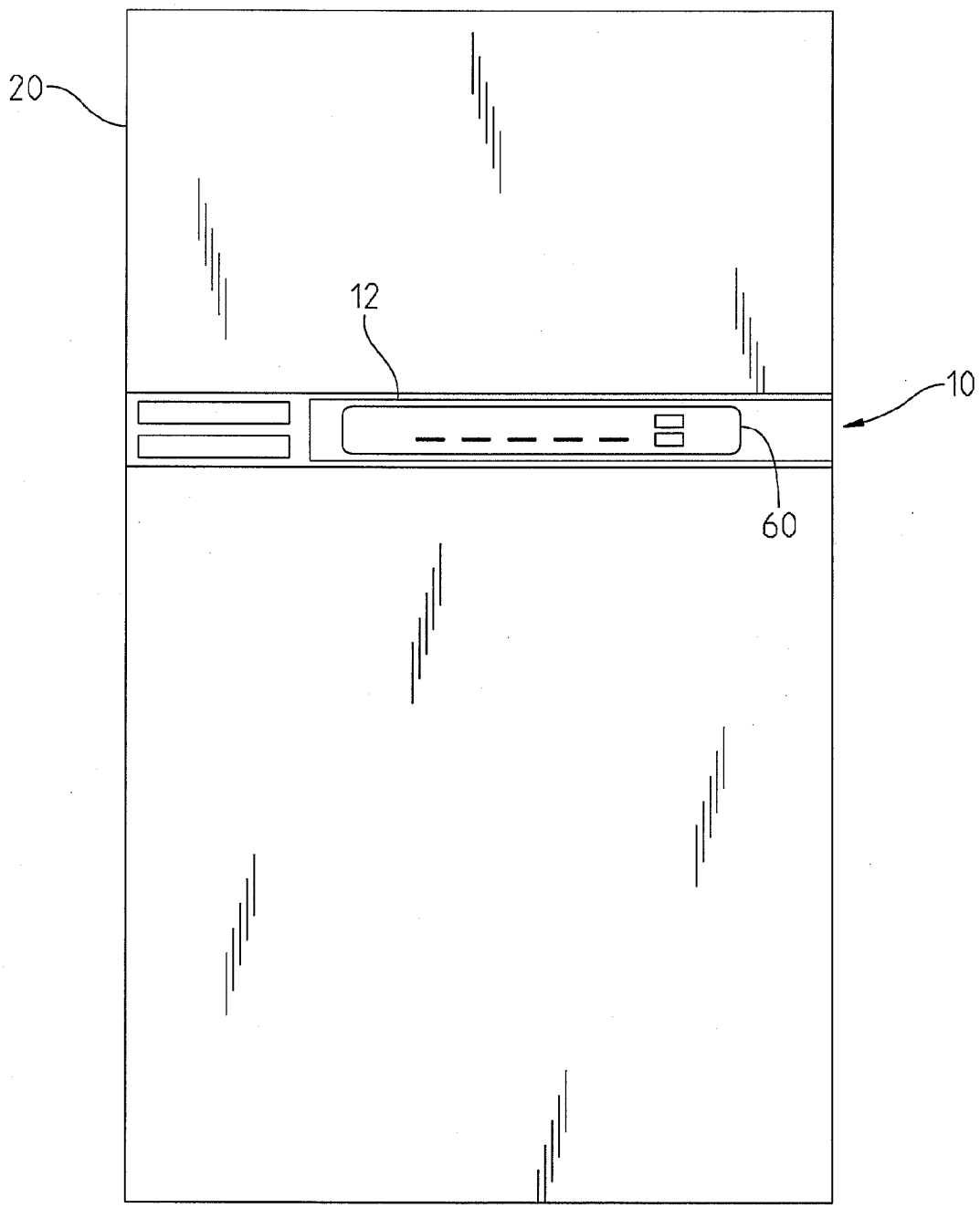
FIG. 1 is a plan view of the front of a refrigerator showing the housing of the invention.
Figure 4:
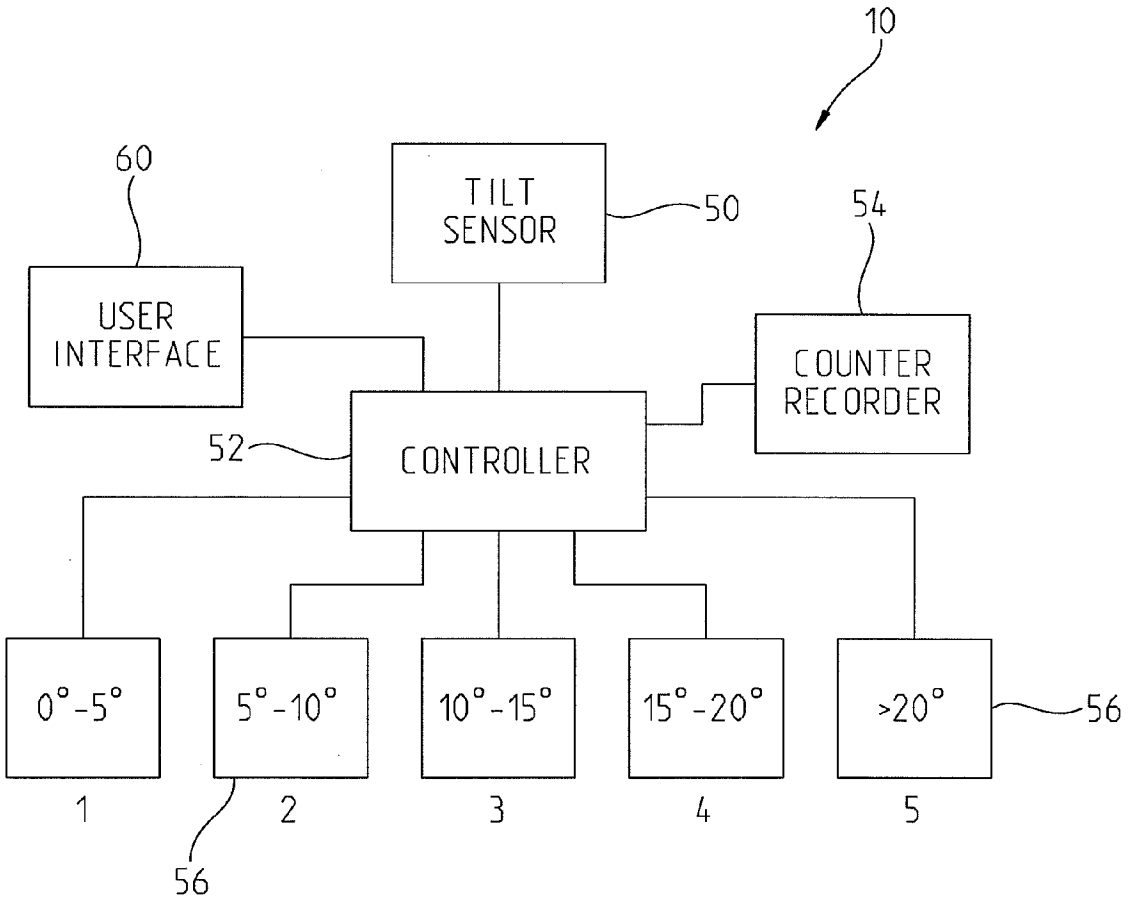
FIG. 4 is a block diagram of the function of the automated control device of the invention.

Referring to FIG. 4, the diagram shows the functionality of the automated control device 10. Skilled artisans may intuit that such a device may be modified so that monitoring and controls in another embodiment may be located remotely in the vehicle, via RF and other known variations. In one commercial embodiment of the invention, these components are electrically connected to a RV refrigerator and maintained within housing 12 like the exemplary embodiment shown in FIG. 1. A tilt sensor 50 is built into the electronic circuits of the controller 52. The sensor measures the angle of inclination of the refrigerator while it is operating, and the controller receives this information via a signal representing the subject angle.

Figure 3C:
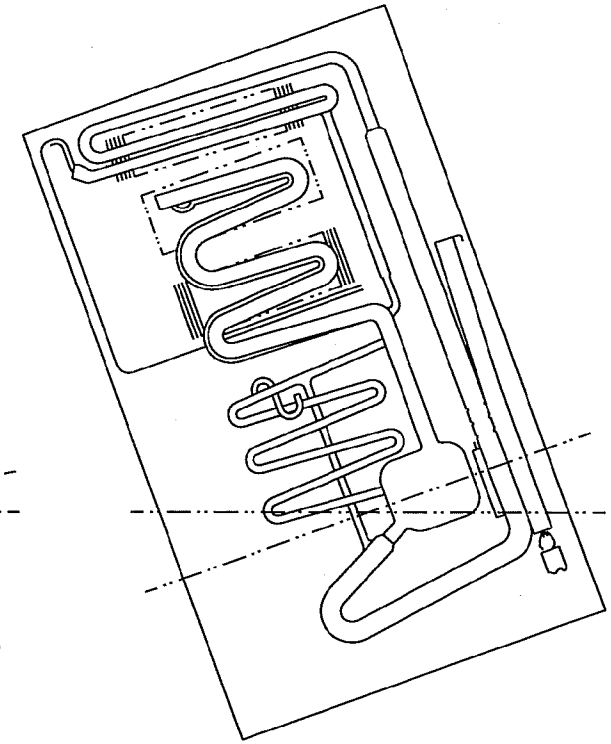
FIGS. 3A-3C show, respectively, the cooling system of the invention five, ten, and fifteen degrees off level.
Figure 3B:
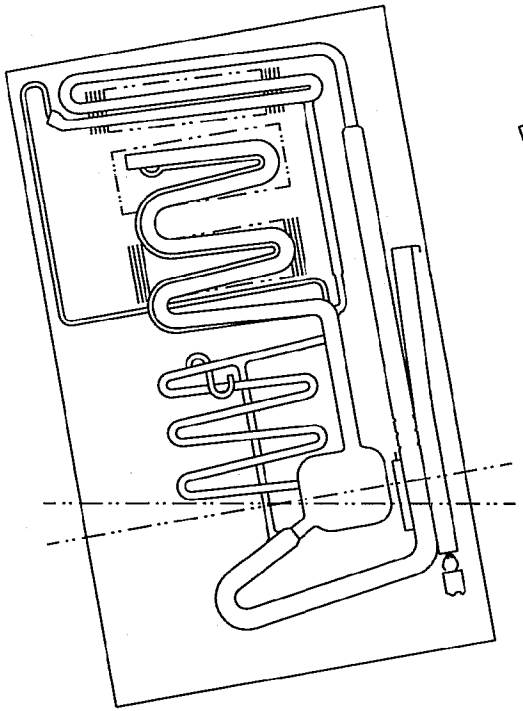
Figure 3A:
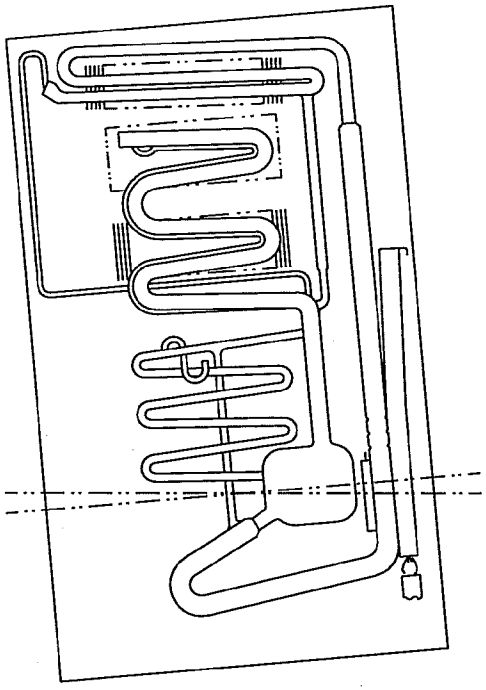

When a RV refrigerator is operated in extreme off-level positions (FIG. 3), the boiler 32 can reach abnormally high temperatures, which in turn induces stress into the cooling system and, for example, around the heated boiler section. With reference to FIGS. 3A-3C, at small deviations from vertical, only a small amount of stress is induced as boiler temperatures rise only modestly.

FIG. 3A shows the system five degrees (5°) off level, which is a relatively small deviation from level that induces modest amounts of stress to the system that may be deemed tolerable. At larger deviations from vertical, however, larger amounts of stress are induced because the boiler temperatures can reach measurements much higher than normal operation. This is because an absorption type cooling system operates by gravity. When the system is not level refrigerant migrates to the lowest height in the conduit system leaving other parts of the system dry and thus especially vulnerable to effects of heat added at the heater or burner.

FIG. 3B shows the system ten degrees (10°) off level; and, FIG. 3C shows the system fifteen degrees (15°) off level. In the later FIG., for example, refrigerant is more likely to flow in the lower left corner of the system. This condition may induce more stress on the system than would otherwise occur because there is less refrigerant in the burner section to absorb heat. To monitor this induced stress, the control maintains a stress counter 54 that records the amount of stress induced into the cooling system.

As shown in FIG. 4, the controller monitors the tilt sensor and then based on the reading, the control identifies the position as one of five (5) classifications, which are schematically represented by 56 in FIG. 4. The first classification is "level" or zone 1. "Level" is defined as vertical to plus or minus five degrees (5°) from vertical. When a refrigerator is operated in a "level" position, no stress is induced into the cooling systems and the stress counter/recorder 54 is not incremented.

The second classification is zone 2. "Zone 2" is defined as between five and ten degrees (5°-10°) off-level. When a refrigerator is operated in zone 2, a small amount of stress is induced into the cooling system and the stress counter is incremented slowly indicating that the cooling system can be operated for long periods of time at this angle of inclination before the stress limit is exceeded. Stress parameters that are characteristic of the particular mechanical components of the system are programmed into the controller during manufacture or installation.

The third classification is zone 3. "Zone 3" is defined as between ten and fifteen degrees (10°-15°) off-level. When a refrigerator is operated in zone 3, a moderate amount of stress is induced into the cooling system and stress counter is incremented more quickly indicating that the cooling system can be operated for shorter periods of time at this angle of inclination before the stress limit is exceeded.

The fourth classification is zone 4. "Zone 4" is defined as between fifteen and twenty degrees (15°-20°) off-level. When a refrigerator is operated in zone 4, a large amount of stress is induced into the cooling system and the stress counter is incremented even more quickly indicating that the cooling system can be operated for even shorter periods of time at this angle of inclination before its stress limit is exceeded.

The fifth classification is zone 5. "Zone 5" is defined as greater than twenty degrees (20°) off-level. When a refrigerator is operated in zone 5, a very large amount of stress is induced into the cooling system and the stress counter is incremented at the fastest rate indicating that the cooling system can only be operated for very short periods of time at this angle of inclination before the stress limit is exceeded.

Operation for a period of time in zone 2 and then in zone 3, results in the stress counter being incremented more rapidly while the refrigerator is in zone 3. Once the refrigerator is returned to a level condition (zone 1) the stress counter ceases to be incremented. Given that the induced stress is permanent in nature, the stress counter records and retains its incremented value and resumes at the value where it left off if and when the refrigerator is operated in an off-level position in the future. This enables recordation of the cumulative stress on the system and around the boiler section so that parts may be replaced before they are worn or a rupture occurs. In the case where a new boiler may be installed, for example, the stress counter 54 may be reset to start over with respect to the new boiler.

The control includes a diagnostic mode that can be accessed by way of a user interface 60, which allows an authorized service technician to monitor the status of the tilt sensor and also the contents of the stress counter. The interface 60 is only for illustration and may include LEDs and touch pad features used by skilled artisans. The interface may be located remotely or within the console of the vehicle.

For the purposes of promoting an understanding of the principles of the invention, specific embodiments have been described. It should nevertheless be understood that the description is intended to be illustrative and not restrictive in character, and that no limitation of the scope of the invention is intended. Any alterations and further modifications in the described components, elements, processes, or devices, and any further applications of the principles of the invention as described herein, are contemplated as would normally occur to one skilled in the art to which the invention relates.

What is claimed is:

1. An automated control device for a refrigerator that has a closed fluid absorption type cooling system with a heat source for heating a mixture of flowable refrigerant and absorbent, said system includes a diffusion agent, the device comprising:

a sensor for measuring the angle of inclination of the refrigerator;

a stress counter/recorder which counts and records a cumulative value representing stress induced into the cooling system;

a controller for receiving signals from the sensor, said controller in communication with a processor executing instructions for:

(i) analyzing the cumulative value representing stress from the stress recorder to identify a condition;

(ii) comparing said condition with a set of condition classifications; and, (iii) limiting the time of operation of the refrigerator according to a time specified by at least one of said classifications.

2. The device according to claim 1, wherein the refrigerant is ammonia, the absorbent is water, and the diffusion agent is hydrogen or helium.

3. The device according to claim 1, wherein said heat source is a gas burner.

4. An automated control device for monitoring an angle of inclination of an absorption type cooling system or refrigerator that circulates a refrigerant, an absorbent, and a diffusion agent within a conduit system, the device comprising:

a housing;

a controller with a processor within the housing;

a sensor in communication with the controller for measuring the angle of inclination of the refrigerator;

a stress counter/recorder connected to the controller for counting and for recording cumulative values representing increments of stress induced into the cooling system; and wherein the controller receives signals and data from the sensor representing information about the angle of inclination of the cooling system or refrigerator, said processor analyzes said signals and instructs the stress counter to increment said cumulative values in proportion to which the cooling system or refrigerator is off level.

5. The device according to claim 4, wherein the refrigerant is ammonia, the absorbent is water, and the diffusion agent is hydrogen or helium.

6. The device according to claim 4, wherein said heat source is a gas burner.

7. The device according to claim 4, wherein the controller comprises a user interface for accessing information about the sensor and the stress counter.

8. The device according to claim 4, wherein the stress counter is assessed using zones, each of said zones comprising increments of five degrees off level.

9. A method for controlling operation of an absorption type cooling system or refrigerator comprising the steps:

providing a sensor in communication with a controller for measuring the angle of inclination of the cooling system or refrigerator, the controller comprising a processor;

providing a stress counter connected to the controller; and by way of the processor, receiving a signal from the sensor when the cooling system or refrigerator is off level and instructing that the stress counter be incremented in a cumulative value in proportion to which the cooling system or refrigerator is off level.

10. The method according to claim 9, wherein said cooling system or refrigerator comprising a conduit system, a refrigerant, an absorbent, and a diffusion agent are contained within said conduit system, and the diffusion agent is hydrogen or helium.

* * * * *